United States Patent [19]

Forbes et al.

[11] 4,045,332

[45] Aug. 30, 1977

[54] SOLVENT EXTRACTION

[75] Inventors: Eric Simon Forbes, Lightwater; Angus Joseph Dickson Reid, Wokingham, both of England

[73] Assignee: The British Petroleum Company Limited, London, England

[21] Appl. No.: 680,695

[22] Filed: Apr. 27, 1976

[30] Foreign Application Priority Data

May 14, 1975 United Kingdom ..... 20319/75

[51] Int. Cl.[2] ..... C01G 21/16

[52] U.S. Cl. ..... 208/323; 208/327; 252/364; 260/674 SE

[58] Field of Search ..... 208/323, 327; 252/364; 260/674 SE

[56] References Cited

U.S. PATENT DOCUMENTS

| | | | |
|---|---|---|---|
| 2,419,499 | 4/1947 | Oosterhout et al. | 208/323 |
| 2,440,442 | 4/1948 | Hillyer et al. | 252/364 |
| 2,485,070 | 10/1949 | Schulze et al. | 208/327 |
| 2,850,461 | 9/1958 | Bloch et al. | 252/364 |

FOREIGN PATENT DOCUMENTS

| | | | |
|---|---|---|---|
| 1,354,173 | 5/1974 | United Kingdom | 208/323 |

*Primary Examiner*—Herbert Levine

*Attorney, Agent, or Firm*—Morgan, Finnegan, Pine, Foley & Lee

[57] ABSTRACT

The degradation of furfural, used in the solvent extraction of aromatics, is inhibited by the use of a furfural-soluble, recoverable amine having a $pK_a$ greater than that of aniline. The preferred amine is N,N-diethyl aniline and the amount used may be 0.001 to 5% wt., preferably 0.01 to 2% wt. by weight of furfural.

The recoverable amine may be used in combination with a non-recoverable amine, eg. tri-ethanolamine, the amount of non-recoverable amine being preferably 1 to 1000 ppm wt., particularly 5 to 50 ppm.

7 Claims, 1 Drawing Figure

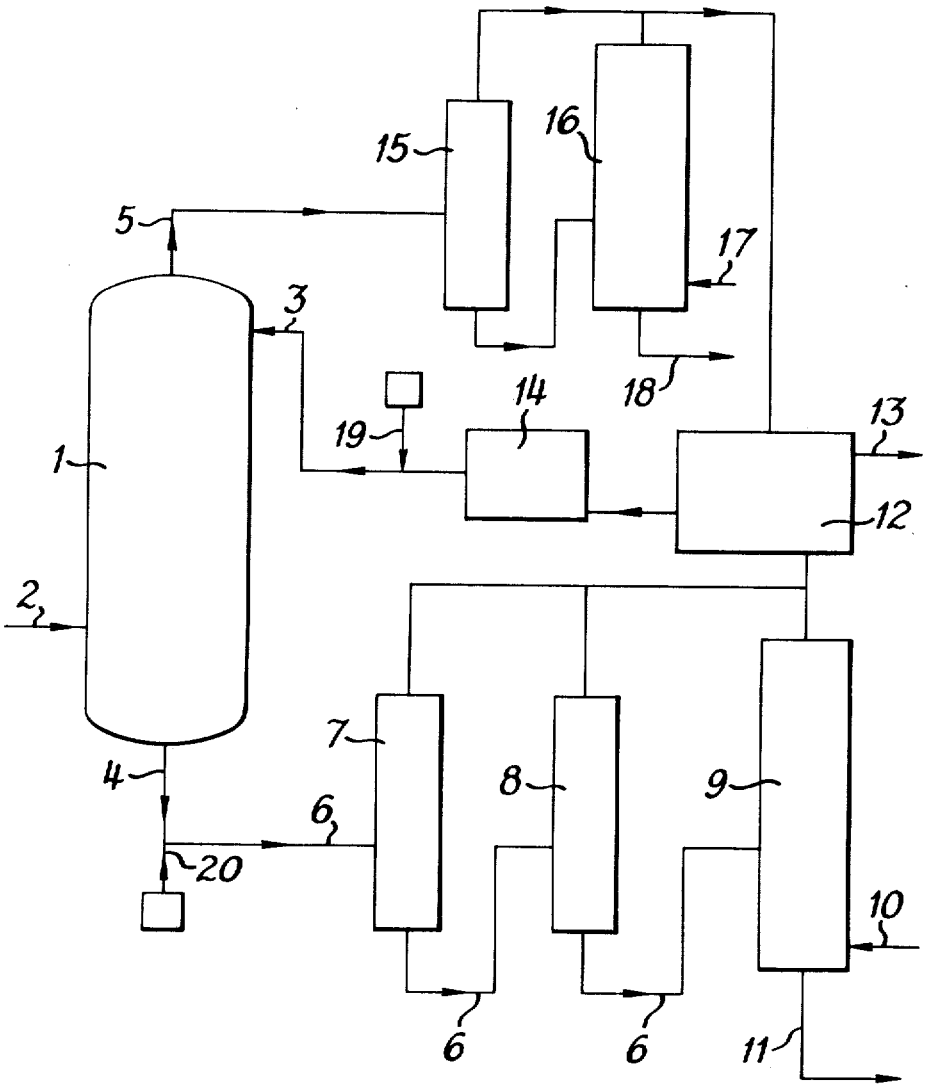
15
16
5
17
3
18
14
19
13
1
12
2
7
8
9
4
6
20
10
6
6
11

SOLVENT EXTRACTION

The invention relates to solvent extraction using furfural as the solvent and in particular to reducing furfural losses. Such losses are believed to result from oxidation occuring during the extraction process leading to acid and resin formation.

In the preparation of some lubricating oils, the oil to be refined is extracted with furfural counter-currently in a column and with-drawn from the column in two phases, a raffinate phase at the head of the column which contains the greater part of the required refined oil and a small quantity of solvent, and an extract phase at the bottom of the column which contains the greater part of the solvent together with predominantly aromatic hydrocarbons extracted from the oil, and smaller amounts of naphthenic hydrocarbons and sulphur compounds.

These two phases may then be separated into their constituents by distillation.

The furfural is recovered from the extract phase by distillation and re-cycled. The distillation normally involves one or more flash distillations and a vacuum distillation using steam. The steam and furfural are recovered overhead and are separated by settling and/or stripping. The relatively smaller amount of furfural combined with the raffinate is also recovered by distillation and recycled. The distillation of the raffinate phase can be less complicated but may also involve steam vacuum distillation.

Elevated temperatures of up to 230° C have to be used in certain parts of the process and, since oxygen cannot be completely excluded, some furfural is lost by acid and resin formation. Such loss should obviously be kept as low as possible and amine anti-oxidants have already been proposed as additives for furfural. The correct choice of amine is however, important.

Firstly, the amine itself should preferably be recoverable for re-use, e.g. in solution in the furfural, otherwise at least a part of the saving resulting from a lower furfural loss will be offset by the cost of the amine. In practice this means that the amine should be recovered overhead in the furfural recovery system. Furfural boils at 162° C and U.K. Pat. No. 1,354,173 describes the use of certain aliphatic amines which remain dissolved in the furfural and which boil between 130 -200° C. It is also known to add higher boiling aliphatic amine inhibitors which are removed with the extract and are not recovered. The fact that they are not recovered increases the cost of their use, and, in addition, their removal with the extract means that they cannot protect the whole of the furfural recovery system.

Secondly, it has been found that the basicity of the amine is important. Oxidation of furfural is believed to proceed via intermediate peroxide formation and previous inhibitors used have been chosen in the belief that relatively strong bases would give the best results. However, in the parts of the recovery system containing steam or water, it has been found that relatively strong bases are partially water-soluble and that the resulting aqueous alkaline solution itself catalyses degradation of the furfural. The loss of furfural by this base-catalysed mechanism can sometimes exceed the saving from peroxide inhibition, but even if it is less, the overall saving will be reduced.

The present invention, therefore, is concerned with the use of relatively weak bases which can be recovered and re-used.

According to the present invention a composition suitable for the solvent extraction of aromatic hydrocarbons from hydrocarbon mixtures containing them comprises furfural and a furfural-soluble, recoverable amine having a $pK_a$ value at 25° C greater than that of aniline.

The preferred amines are N,N,-diallcyl anilines where the alkyl groups contain from 1 to 5 carbon atoms. The alkyl groups may be the same or different. A particularly preferred amine is N,N,-diethyl aniline but N,N-dimethyl aniline may also be suitable. The relevant $pK_a$ constants are Aniline — 4.63 at 25° C
N,N-diethyl aniline — 6.61 at 22° C
N,N-dimethyl aniline — 5.15 at 25° C The term "recoverable" means that the amine is recovered overhead in a furfural recovery system. It has been found that it is not necessary for the amine to have a boilihg point close to that of furfural, provided it is steam volatile and, therefore, distils off with the furfural and steam in the steam vaccum distillation columns. N,N-diethyl aniline, for example, has a boiling point of 216° C.

The relatively high pKa value means that the amine is sparingly soluble in water and hence will not catalyse furfural degradation in the wet parts of the system. Being furfural soluble it will dissolve in the furfural in the furfural-water separators and be recycled.

Experiments have shown that N,N'diethyl aninline is stable under the conditions and temperatures of the furfural recovery system. It can be detected, quantitatively, by GLC analysis in furfural (and also in the oil feedstock and the raffinate product) so the amount of amine in the system can be readily monitored and any make-up amine added as necessary, preferably by addition to the extract/furfural mixture as it leaves the extraction column. Alternatively, make-up amine may be added to the recycle furfural before it enters the extraction column.

The amount of amine used may be from 0.001 to 5% by weight of furfural, preferably from 0.01 to 2% by weight. Since the amine is recoverable and does not catalyse degradation in the wet parts of the system it can be used in relatively large amounts, which will be sufficient to inhibit peroxide formation despite its relatively low basicity. The precise amount used can, in fact, be related to the basicity, since a balance can be struck between base-catalysed degradation and peroxide inhibition. The lower the basicity, the more amine can be used to give effective inhibition of peroxide formation because the less is the risk of base-catalysed degradation. If the basicity is higher the risk of base-catalysed degradation may increase, but a lesser amount will give effective peroxide inhibition, so the amount of base-catalysed degradation remains low.

The amines of the present invention may be used as the sole additive, but may also be used in combination with a non-recoverable inhibitor. Non-recoverable inhibitors are already known and used and are normally alkylamines, or alkanolamines boiling above 200° C, for example triethanolamine which boils at 360° C. These non-recoverable amines are preferably more basic than the amines of the present invention, i.e. they will have a $pK_a$ less than that of aniline. Being relatively strong bases they act preferentially as the inhibitors in the dry parts of the system prior to their removal from the system with the extract, leaving the amines of the present invention free to act in the other down-stream parts of the system.

Preferably the non-recoverable inhibitors are added to the furfural in an amount of 1-1000 parts per millions weight, by weight of furfural, more preferably 5-50 parts per million and are preferably added to the extract/furfural mixture as it leaves the extraction column.

The furfural-amine compositions of the present invention can be used for the solvent extraction of any hydrocarbon fractions boiling above the boiling point of furfural e.g. hydrocarbon mixtures boiling above 200° C. It is especially useful for the solvent extraction of hydrocarbon lubricating oils, e.g. petroleum fractions boiling in the range 350 - 650° C. It may be used for the separation of hydrocarbon fractions into primary extracts and raffinates and also for the further extraction of such products to give secondary extracts and pseudo-raffinates, or secondary raffinates and pseudo-extracts.

The solvent extraction and the furfural recovery conditions may be those normally used.

Preferably the counter-current extraction takes place in a column where the top temperature is 140° C maximum and the base temperature is in the range 40 to 120° C. Furfural:oil ratios in the range 0.3 to 4.0:1 may be used.

The accompanying drawing is a schematic diagram of a typical unit for furfural extraction, used in the production of lubricating oils.

In the drawing, a solvent extraction tower 1 has an oil inlet 2, a furfural inlet 3, an extract outlet 4 and a raffinate outlet 5. The extract passes through line 6 to, successively, a low pressure flash tower 7, a high pressure flash tower 8 and vacuum distillation column 9. Steam is injected into column 9 at 10. Extract free of furfural is recovered from the base of column 9 through line 11. Furfural flashed off overhead from towers 7 and 8 and a steam-furfural mixture taken off overhead from column 9 passes to a furfural-water separator system 12. Water is taken off at 13 and dry furfural passes to an accumulator 14 and then back to extraction tower 1.

The raffinate from outlet 5 is similarly passed through a flash tower 15 and vacuum column 16 having steam injection at 17. Raffinate free of furfural is withdrawn from the base of column 16 through line 18 and furfural taken off overhead from 15 and 16 is passed to the furfural-water separator system 12 for eventual recycle.

With the present invention, the need for adding make-up furfural or make-up amine is minimised, but if such addition is required, furfural and/or amine may be injected into the recycle furfural at 19. Alternatively, and preferably, make-up furfural and/or amine may be added to the furfural extract at 20. If a non-recoverable amine is also used it is also preferably added to the furfural extract at 20.

The invention is illustrated by the following comparative examples.

EXAMPLE 1

The Effect of Inhibitors on Furfural Oxidation under Dry Condtions

A sample of freshly distilled furfural (2.0 gm) was weighed into a 150 ml capacity oxidation flask. The flask was attached to a gas burette and the entire system evacuated and filled with oxygen. The flask was then attached to a shaker and oxidations carried out over 1-5 hours at temperatures of 50 -125° C.

At the end of each oxidation test the contents of the oxidation flask were transferred to a 100 ml graduated flask and made up to the mark with toluene.

A number of runs were carried out using furfural alone and furfural containing 1000 ppm wt. of various inhibitors. The following data were obtained:

Oxygen uptake — measured by the gas burette connected to the closed container during the heating.

Furfural loss — measured by GLC analysis of the toluene — furfural product.

Acidity — measured on the toluene — furfural product by Test Method IP 1/64.

Resin formation — the weight of the insoluble portion of the toluene — furfural product was determined.

The results are shown in Table 1 below.

Table 1

| | | The Effect of Inhibitors on Furfural Oxidation | | | | |
|---|---|---|---|---|---|---|
| Analysis | Inhibitor used | None | Recoverable substituted alkanolamine (diethyl-ethanol-amine) | Non-recoverable substituted alkanolamine (triethanolamine) | Hindered phenol | N,N-diethyl aniline |
| 5 Hours at 125° C | | | | | | |
| $O_2$ Uptake | mls | 15.5 | 7.15 | 10.1 | 13.7 | 8.6 |
| Furfural loss | % wt | 14.2 | 4.18 | 6.4 | 9.35 | 6.8 |
| Acidity | % wt | 3.4 | 1.85 | 2.9 | 3.6 | 2.8 |
| Resin | % wt | 5.4 | 1.76 | 2.9 | 4.13 | 2.9 |
| 5 Hours at 75° C | | | | | | |
| $O_2$ uptake | mls | 27 | 1.4 | 2.65 | 8.0 | 1.1 |
| Furfural loss | % wt | 14 | 0.5 | 1.03 | 1.6 | 0.5 |
| Acidity | % wt | 5.5 | 0.27 | 0.48 | 1.4 | 0.38 |
| Resin | % wt | 3.5 | 0 | 0.27 | 0 | 0 |

The table shows that the uninhibited furfural was severely degraded with appreciable acid and resin formation. All the inhibitors used gave improved results, with the amines performing better than the phenol. In this test, carried out with dry furfural, the aromatic amine of the present invention, gave generally comparable results to the alkanolamines, despite its lower basicity. It did not, however, on this test alone, show any marked advantage over the known alkanolamines.

EXAMPLE 2

The Effect of Inhibitors on Furfural Oxidation under Wet Conditions 2.0g of furfural and 1.0g of water were heated at 125° C for 2 hours under an atmosphere of oxygen with shaking of the container as in Example 1. The container was cooled and the contents made up to 100 mls with toluene, also as in Example 1. The furfural loss was determined by GLC analysis of the toluene solution and the colour of the toluene and the separated water layer observed visually.

3 runs were carried out using uninhibited furfural, furfural containing 1% wt. of N,N-diethyl aniline, and furfural containing 1% wt. of a recoverable substituted alkanolamine. The results are shown in Table 2 below.

Table 2

| Degradation of Furfural in Aqueous Media | | | |
|---|---|---|---|
| Inhibitor | Furfural loss % | Visual observations | |
| None | 1.8 | $H_2O$ | Brown |
| | | Toluene | Pale Green |
| 1% wt. of N,N-diethyl aniline | 0 | $H_2O$ | Water White |
| | | Toluene | Pale Green |
| 1% wt. recoverable substituted alkanolamine (diethyl-ethanolamine) | 5.4 | $H_2O$ | Dark Brown |
| | | Toluene | Yellow Brown |

The table shows that uninhibited furfural was also degraded under wet conditions and that an alkanolamine inhibitor appeared to catalyse the degradation, giving a worse result than the uninhibited furfural. The N,N-diethyl aniline of the present invention, however, effectively inhibited the degradation of the furfural and had no catalytic effect.

EXAMPLE 3

The effectiveness of N,N-diethyl aniline (DAN) in combination with a non-recoverable inhibitor viz triethanolamine (TEA) was examined by refluxing partially degraded furfural for 6 hours under nitrogen with one or both of the additives, and then vacuum distilling to remove degradation products as a residue. The partially degraded furfural was prepared by an initial refluxing in air for 2 hours. Samples were taken after refluxing under nitrogen, and after distillation and analysed for additive content. The results are shown in Table 3 below.

Table 3

| Sample | % wt. of DAN remaining after reflux | % wt. of DAN remaining after reflux + distillation | % of total nitrogen in residue |
|---|---|---|---|
| Furfural + 0.1% wt. TEA | — | — | 98.7 |
| Furfural + 1.0% wt. DAN | 45.8 | 4.6 | 66.2 |
| Furfural + 0.1% wt. TEA and 1.0% wt. DAN | 43.1 | 23.3 | 71.3 |

The results in Table 3 confirm that TEA is non-recoverable since, when used on its own, 98.7 of it remained in the residue after distillation. When DAN was used, either alone or in combination with TEA, however, not all of the additive content went into the residue.

The table also shows a higher DAN recovery after distillation when it was used in combination with TEA, indicating that the TEA was preferentially reacting with the particularly degraded furfural leaving a greater proportion of unreacted DAN.

The recovery of DAN when used with fresh, non-degraded furfural was also measured by adding DAN, with and without TEA, to fresh furfural and vacuum distilling. The results obtained were:

| | Overall % wt DAN recovery |
|---|---|
| Furfural + 1.0% wt. DAN | 88.2 |
| Furfural + 1.0% wt. DAN + 0.1% wt. TEA | 91.9 |

The good recoveries are to be noted, as well as the slightly higher recovery when DAN was used with TEA.

EXAMPLE 4

Recoveries of DAN in an extract vacuum distillation column 9 (see FIG. 1), a raffinate vacuum distillation column 16, and the furfural-water separator 12 were measured using furfural/oil mixtures selected to simulate the production of high viscosity index lubricating oils from Middle Eastern wax distillate feedstocks commonly used in this process. The amounts of materials used and the DAN recoveries are given below.

a. Extract vacuum stripper 2500 ml extract from 150 neutral production
570 ml furfural
12 ml DAN (1.67% wt. on furfural:0.36% wt. on total feed)
1 ml TEA (0.17% wt. on furfural:360 ppm wt. on total feed)

| | % wt. of furfural passing overhead | % wt. of DAN passing overhead |
|---|---|---|
| Furfural, extract, and DAN | 95.6 | 88.5 |
| Furfural, extract, DAN and TEA | 95.0 | 88.3 |

b. Raffinate vacuum stripper 2661 ml raffinate from 70 spindle oil production
276 ml furfural
2.25 ml DAN (0.65% wt. on furfural:811 ppm wt. on total feed)

| | % wt. of furfural passing over head | % wt. of DAN passing overhead |
|---|---|---|
| Furfural, raffinate and DAN | 95.8 | 99.8 |

c. Furfural-Water Separator

This separator unit consists of a decanter, a furfural-water stripper which receives the aqueous layer from the decanter, and a furfural-water fractionator which receives the furfural layer from the decanter. In a laboratory simulation of the fractionator were:

225 g furfural
22.5g water
2.5g DAN (1.0% wt. on total feed)

Distillation of this mixture with a reboiler temperature of 105 – 110° C gave 99% recovery of DAN in the furfural.

During the above experiments it was noted that the presence of DAN in the vessel did tend to encourage emulsion formation (up to 15% wt. emulson containing 33% furfural when using 1% wt. of DAN). However, addition of sodium bicarbonate solution to the decanter to control the pH of the water phase to the range 5 - 7 prevented the formation of any emulsion when using 0.8% wt. of DAN.

Analysis of the furfural layer for DAN content confirmed a negligible loss of DAN into the water layer.

Since the furfural-water stripper contained mainly water and any furfural present was recycled to the decanter, it was concluded that no loss of DAN could be incurred in this unit.

We claim:

1. A composition suitable for the solvent extraction of aromatic hydrocarbons from hydrocarbon mixtures containing them comprising furfural and from 0.001 to 5% wt. by weight of furfural, of a furfural soluble recoverable amine selected from the group consisting of N,N-dialkyl anilines, in which the alkyl groups have from 1 to 5 carbon atoms.

2. A composition as claimed in claim 1 wherein the furfural-soluble amine is N,N,-diethyl aniline.

3. A composition as claimed in claim 1 wherein the furfural-soluble amine content is from 0.01 to 2% wt. by weight of furfural.

4. A composition as claimed in claim 1 which also contains from 1 to 1000 ppm wt, by weight of furfural of a non-recoverable amine having a boiling point above 200° C and $pK_a$ less than that of aniline.

5. A composition as claimed in claim 4 wherein the non-recoverable amine content is from 5 to 50 ppm wt. by weight of furfural.

6. A process for the solvent extraction of hydrocarbon mixtures boiling above 200° C using furfural as the solvent, characterized in that the furfural contains from 0.001 to 5% wt. by weight of furfural, of a furfural-soluble, recoverable amine selected from the group consisting of N,N-dialkyl anilines in which the alkyl groups have from 1 to 5 carbon atoms.

7. A process as claimed in claim 6 wherein the hydrocarbon mixture is a petroleum fraction boiling in the range 350° to 650° C.

* * * * *